United States Patent [19]

Lurry

[11] 4,311,207

[45] Jan. 19, 1982

[54] LADDER ATTACHMENT

[76] Inventor: Percell C. Lurry, Aylett, Va. 23009

[21] Appl. No.: 130,157

[22] Filed: Mar. 13, 1980

[51] Int. Cl.[3] ..... E06C 7/48; E06C 1/36

[52] U.S. Cl. ..... 182/206; 182/45; 182/214; 182/107

[58] Field of Search ..... 182/206, 45, 163, 164, 182/214, 107

[56] References Cited

U.S. PATENT DOCUMENTS 1,423,998 7/1922 Camp ..... 182/45
2,341,510 2/1944 Born ..... 182/206
2,597,902 5/1952 Roketa ..... 182/214
4,179,011 12/1979 Morawski ..... 182/45

*Primary Examiner*—Reinaldo P. Machado
*Attorney, Agent, or Firm*—Brady, O'Boyle & Gates

[57] ABSTRACT

A ladder attachment including an adjustable frame assembly detachably connected to the end of a section of a conventional extension ladder, the frame assembly cooperating with the side rails of the ladder to form a hook portion for extending over the ridge of a pitched roof to thereby allow the ladder to be supported in an inclined position on the roof.

4 Claims, 2 Drawing Figures

LADDER ATTACHMENT

BACKGROUND OF THE INVENTION

In the performance of their occupation, workmen, such as painters, carpenters, roofers, and the like, are required, at times, to perform their work on inclined roofs. To work on highly pitched roofs, it is necessary that the workman position some type of support, such as a ladder, or scaffold, on the roof. When the job is not too extensive, a section of a conventional extension ladder is often employed wherein the ladder is supported in an inclined position on the roof with the lower end of the ladder engaging a gutter at the lower end of the roof. This arrangement results in a hazardous condition since the gutter is liable to become detached from the roof allowing the ladder to slide downwardly thereon. To overcome this problem, it has been proposed to provide ladders with hooks for engaging the ridge of the roof; such an arrangement is shown, for example, in U.S. Pat. Nos. 599,963; 2,755,981 and 3,606,226. While these hook assemblies have been satisfactory for their intended purpose, they have been subject to certain disadvantages, such as being integrally connected to the ladder, thereby rendering the ladder cumbersome when using the ladder on other jobs not requiring the hook assembly; also, many of the hooks are not adjustable for properly engaging ridges of roofs of different pitches.

To overcome the disadvantages experienced in ladder hooks employed heretofore, after considerable research and experimentation, the ladder attachment of the present invention has been devised which comprises, essentially, a frame pivotally connected to the end of a section of a conventional extension ladder, and a pair of adjustment braces, each of which has one end connected to the ladder and the opposite end portion connected to the frame. By this construction and arrangement, the frame and side rails of the ladder cooperate to form a hook assembly engageable with a roof ridge, and the adjustment braces allow the frame to be adjusted at various angles relative to the ladder to accommodate ridges of corresponding angles. The frame is also provided with rollers to facilitate sliding the ladder on the inclined roof when arranging the ladder in the operative position, and for removing it therefrom.

DESCRIPTION OF THE PREFERRED EMBODIMENT

Figure 1:
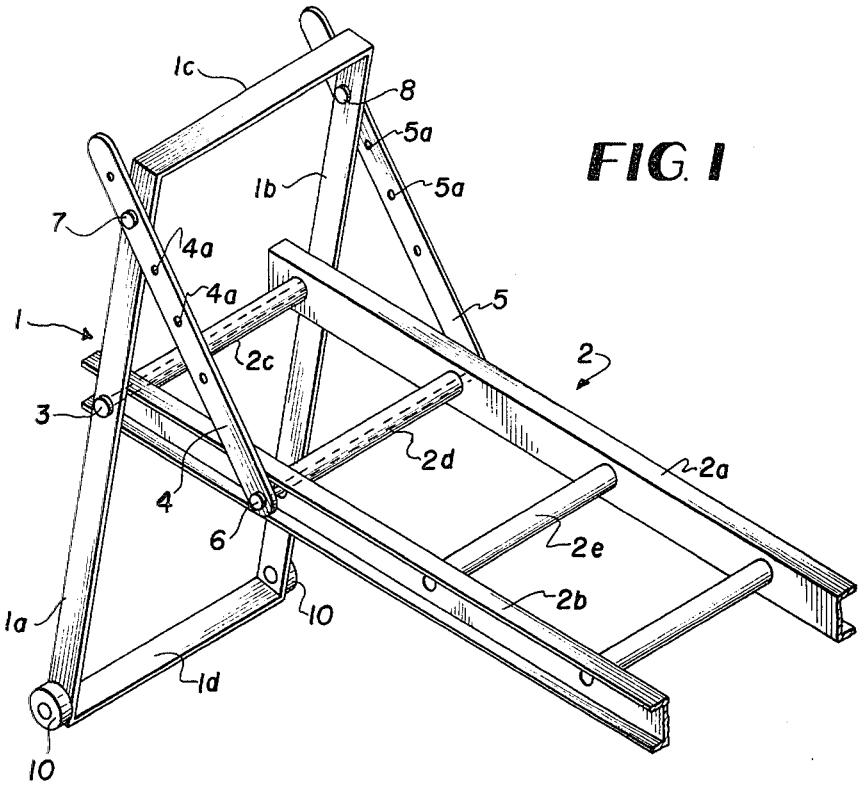
FIG. 1 is a perspective view of the ladder attachment of the present invention connected to an end of a ladder.

Referring to the drawings and more particularly to FIG. 1 thereof, the ladder attachment of the present invention comprises a rectangular frame 1 having side members 1*a*, 1*b* and end members 1*c*, 1*d*. The frame 1 is adapted to be connected to a section of a conventional aluminum extension ladder 2 having channel members 2*a*, 2*b* forming the side rails of the ladder, and tubular members 2*c*, 2*d*, 2*e* extending between the rails forming the rungs of the ladder. The frame 1 is connected to the ladder 2 by a bolt assembly 3 extending through frame side member 1*a*, the tubular rung 2*c* at the end of the ladder, and the frame side member 1*b*, whereby the frame 1 is pivotally connected to the ladder 2.

Figure 2:
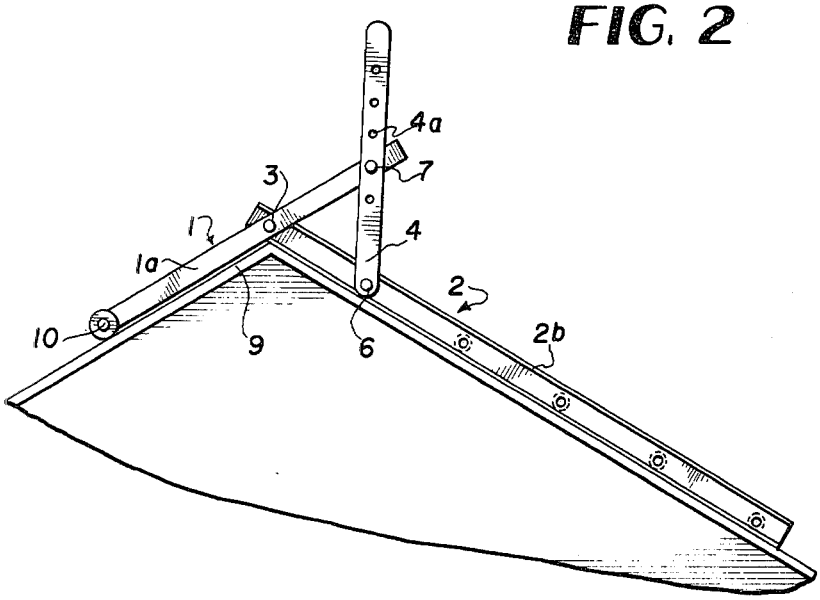
FIG. 2 is a side elevational view of the attachment and ladder mounted in operative position on an inclined roof.

To hold the frame 1 in an adjusted position relative to the ladder 2, a pair of braces or links 4 and 5, having a plurality of longitudinally spaced apertures 4*a*, 5*a*, are provided. One end of each link is connected to the ladder 2 by a bolt assembly 6 extending through brace 4, tubular rung 2*d* and link 5; the opposite end portion of each link being connected to the respective side frame members 1*a*, 1*b* by bolts 7 and 8 extending through apertures in the side frame members 1*a*, 1*b* aligned with a selected aperture 4*a*, 5*a* in the links. By the construction and arrangement of the frame 1, ladder 2, and links 4 and 5, it will be readily apparent that the frame 1 and side rails 2*a*, 2*b* of the ladder cooperate to form a hook portion adapted to extend over a roof ridge 9, as shown in FIG. 2, and by means of the links 4 and 5, the frame 1 can be adjusted to various angles relative to the ladder 2 to conform the hook portion to the corresponding angle of the roof ridge.

To complete the structure of the attachment, a pair of rollers 10 are journaled on each side frame member 1*a*, 1*b* which roll on the roof surface to facilitate positioning the ladder in the operative position and for removing it therefrom.

When the attachment is not required, it can be easily detached from the ladder by removing bolt assemblies 3 and 6.

While the attachment of the present invention has been shown and described attached to a conventional aluminum ladder, it will be appreciated by those skilled in the art that the attachment can also be used on conventional wooden extension ladders by drilling holes in the ladder side rails in proximity to the end rung, and next adjacent rung through which the bolt assemblies 3 and 6 would extend.

From the above description, it will be readily appreciated that the ladder attachment of the present invention provides an improved hook assembly which can be adjusted to accommodate roofs of different pitches, while also being easily detachable from the ladder when not required to thereby leave the ladder unencumbered.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ladder attachment comprising a rigid rectangular frame having a pair of spaced, parallel side frame members and a pair of transversely extending end frame members connected to said side frame members at the ends thereof, a first bolt assembly extending transversely through the side frame members substantially intermediate the ends thereof and through the side rails of a ladder at one end thereof, whereby the rectangular frame is freely pivoted to the end of the ladder, a pair of links, a second bolt assembly extending transversely through one end of each link and the side rails of the ladder to thereby pivotally connect the links to said ladder side rails, a plurality of longitudinally spaced apertures provided in each of said links, an aperture provided in each of said side frame members of said rectangular frame adapted to be aligned with a respective selected aperture in said links, a third bolt assembly insertable through a selected aperture in the links and through an aligned aperture in the side frame members of said rectangular frame to thereby hold the frame member at an angular position relative to the ladder, said angular position being changeable by merely removing said third bolt assembly from a selected aperture in said links and inserting said third bolt assembly through another selected aperture in said links and through said aligned apertures in said side frame members, whereby the rectangular frame cooperates with the ladder to form a hook portion adapted to extend over the ridge of a pitched roof while the ladder is supported at an inclined position on the roof.

2. A ladder attachment according to claim 1, wherein roller means are connected to the side frame members to facilitate rolling the ladder and associated attachment on a roof surface.

3. A ladder attachment according to claim 1, wherein the ladder comprises a section of a conventional extension ladder having tubular rungs, said first bolt assembly extending through the tubular rung at one end of the ladder section.

4. A ladder attachment according to claim 3, wherein said second bolt assembly extends through one end of each link and the next adjacent rung to said end rung.

* * * * *